United States Patent [19]

Scheiterlein

[11] Patent Number: 4,860,719

[45] Date of Patent: Aug. 29, 1989

[54] MAGNETIC HOLD-DOWN DEVICE FOR CROSSBOW

[75] Inventor: Ernst Scheiterlein, New Berlin, Wis.

[73] Assignee: Anthony J. Czaja, West Allis, Wis. ; a part interest

[21] Appl. No.: 117,049

[22] Filed: Nov. 5, 1987

[51] Int. Cl.[4] ..... F41B 5/00

[52] U.S. Cl. ..... 124/25; 124/41 B; 124/26

[58] Field of Search ..... 124/25, 3, 41 B, 21, 124/26, 41 R; 269/8; 104/249, 295; 248/309.4; 211/DIG. 1

[56] References Cited

U.S. PATENT DOCUMENTS

| | | | |
|---|---|---|---|
| 2,269,149 | 1/1942 | Edgar | 269/8 X |
| 2,383,008 | 8/1945 | Meister | 269/8 |
| 2,786,461 | 3/1957 | Pelsue, Jr. | 124/25 |
| 3,572,311 | 3/1971 | Baer | 124/24 R X |
| 4,343,286 | 8/1982 | Thacker | 124/24 R |

*Primary Examiner*—Andrew V. Kundrat
*Assistant Examiner*—Carol I. Bordas
*Attorney, Agent, or Firm*—Fuller, Puerner & Hohenfeldt

[57] ABSTRACT

A hold down device for a crossbow arrow or bolt uses a magnet supported and adjustably positionable in the tray beneath the ferro magnetic arrow head to hold the arrow against the arrow rest.

3 Claims, 1 Drawing Sheet

MAGNETIC HOLD-DOWN DEVICE FOR CROSSBOW

FIELD OF INVENTION

The invention relates to weapons and particularly crossbows.

BACKGROUND OF THE INVENTION

Crossbows are typically maintained in a cocked or ready firing position prior to use. Mechanism adjacent the rear of the arrow holds the string and the nock of the arrow in place. Crossbows also have an arrow rest intermediate the length of the arrow. Problems are encountered in maintaining the arrow in firing position and in consistent portion on the arrow rest. Moving the crossbow around while in a cocked ready position can result in the arrow falling off the arrow rest. In which case, the crossbow ceases to be in a ready firing position. One attempt to solve this problem is a three point arrow rest in which a ring shaped device has arrow rest tips projecting inwardly and spaced at 120° with a central opening to support the arrow. This device has not become popular because the arrow feathers can hit these projections and the drag on the arrow also can interfere with the arrow trajectory.

SUMMARY OF THE INVENTION

The invention provides a non-arrow contacting magnetic hold-down device which cooperates with the ferro-magnetic arrow head to hold the arrow in place on the arrow rest without actually making any physical contact directly with the arrow. The magnetic hold-down device is a magnet adjustably positioned in a tray beneath the arrow head and spaced to provide a clearance to avoid contact and friction on the arrow or displacement of the arrow when released. If the arrow shaft is of non-magnetic material, the magnet typically will be positioned beneath the arrow head or beneath a ferromagnetic band on the arrow. If the arrow is of magnetic material, the arrow rest can be placed in any convenient position on the frame of the crossbow. The clearance of the magnet and tray with respect to the arrow also affords clearance with the feathers.

Various shapes of magnets and trays can be utilized. A convenient place for securing the tray is at the position where the crossbow carrying handle is secured to the frame. Further objects, advantages and features of the invention will become apparent from the disclosure.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
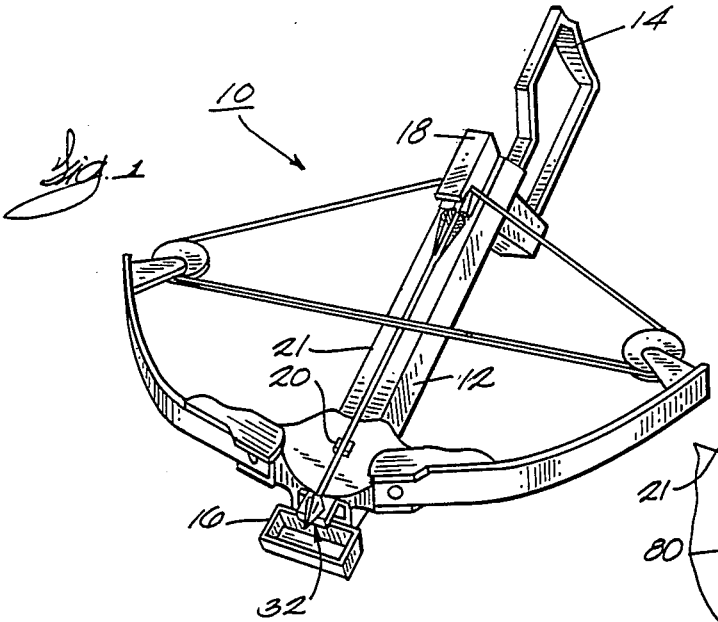
FIG. 1 is a perspective view of a crossbow embodying the invention.

FIG. 1 shows a crossbow 10 with a stock frame portion 12, a handle and rear end portion 14, and a handle or fore end portion 16. The crossbow has a string and string release mechanism 18 controlled by a trigger, not shown. An arrow rest 20 supports the arrow above the upper surface 21 of the stock or frame portion 12 in a firing position as shown in FIG. 1.

Figure 2:
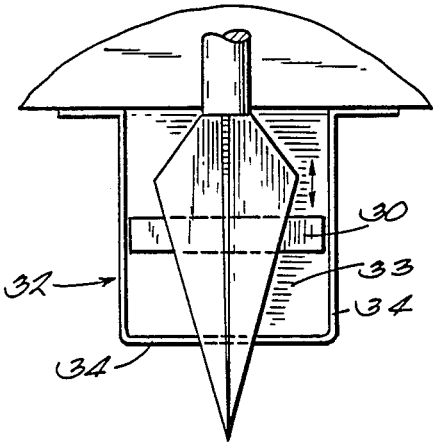
FIG. 2 is an enlarged plan view of the hold-down device shown in FIG. 1.
Figure 3:
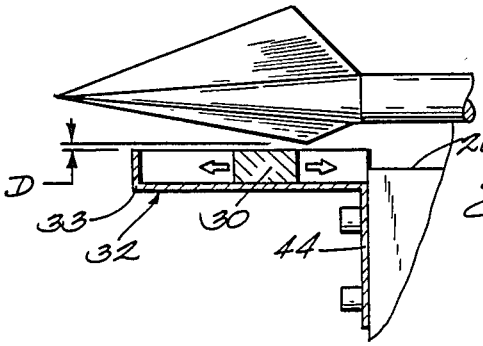
FIG. 3 is a side elevational view of the magnetic hold-down device shown in FIG. 2.
Figure 4:
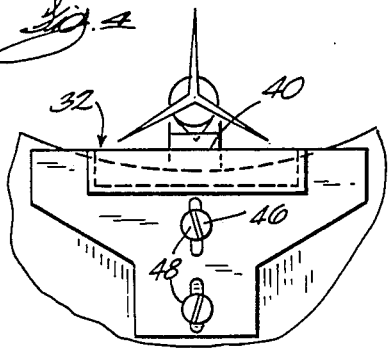
FIG. 4 is a front end view of the hold-down device shown in FIGS. 1, 2 and 3.

In accordance with the invention, cooperative magnetic means on the arrow and frame for holding the arrow in place in the arrow rest in a fire ready position are provided. In the disclosed construction in FIGS. 1, 2 and 3, the magnetic means comprises a rectangular bar-shaped magnet 30 which is supported in a tray 32. The tray 32 has a bottom wall 33, which is generally parallel to the longitudinal axis of the arrow and which is provided with upturned walls 34 formed from the margins of the tray which provide a border for retaining the magnet 30 in place and preventing displacement of the magnet 30. As shown in FIGS. 2 and 3, the magnet is sized in dimension to fit within the walls 34 of the tray, hence it can be adjustably positioned within the tray. The tray is desirably made of ferromagnetic material and hence the magnet is retained in its selected position by magnetic attraction to the tray. It can be moved fore and aft as shown by the arrows in FIGS. 2 and 3 to impose the appropriate hold down capability to the arrow head and hold the arrow against the arrow rest 40 (FIG. 4). As shown in FIG. 3, a clearance D is provided between the arrow head and the magnet so that the magnet does not frictionally engage or hit the magnet during use. This clearance is adequate to provide the desired hold-down capability by magnetic attraction of the magnet to the arrowhead, but spaced sufficiently to ensure that no contact is made between the arrow head or feathers which could interfere with the arrow flight.

Figure 6:
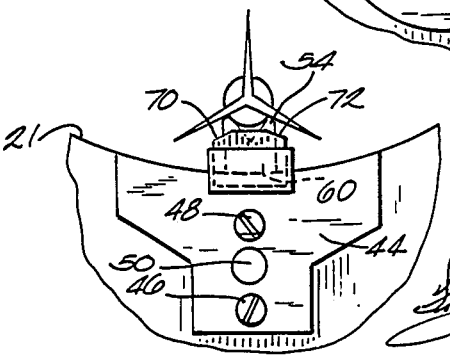
FIG. 6 is a further modified embodiment.

The tray is provided with a depending flange portion 44, which can be provided with suitable slots 46 and bolts 48 to secure the tray to the forward end of the stock. The slots afford vertical height adjustment of the magnet. Typically, the tray will be mounted beneath the bolt 52 which holds the handle to the stock. The flange will be provided with an aperture 50 to receive the mounting bolt for the handle 16. The arrow rest 54 is typically V-shaped as shown in FIG. 6 and desirably provided with a resilient or elastomeric backup block 60 to reinforce the flexible arrow rest and maintain the arrow rest 54 in place. Otherwise, the magnetic attraction of the magnet to the arrow head will tend to flatten the arrow rest.

Figure 7:
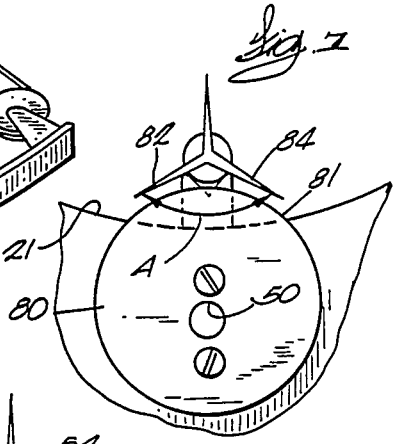
FIG. 7 is an additional modified embodiment of the hold-down device.
Figure 5:
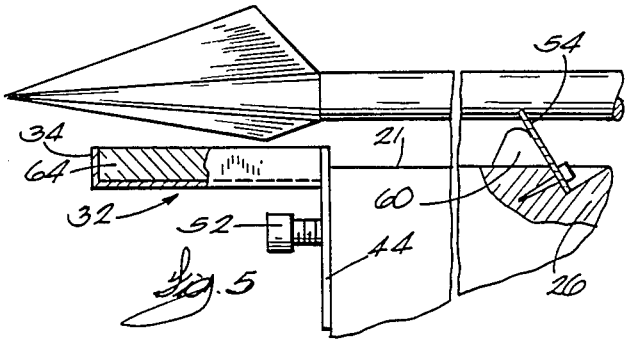
FIG. 5 is a modified embodiment of the hold-down device shown in FIG. 3.

The embodiment of the invention shown in FIG. 5 includes a rectangular magnet 64 which substantially fills the entire tray. In FIG. 6, the tray is rather narrow compared to the tray shown in FIG. 2, and provides a magnet which has beveled edges 70, 72 to fit in close proximity with the arrow head without engaging the arrow head blades. FIG. 7 shows a ring shaped magnet 80 which has an appropriate radius so that the circumference 81 is such that it fits within the angle A between the to nest within the angle between the blades 82 and 84 without contacting the same. Any suitable magnet can be employed, ceramic magnets or otherwise.

Although in the disclosed construction the magnet is placed beneath the arrow head it also could be placed at any convenient point opposite a magnetically attractable part on the arrow at a point remote from the arrow nock to obtain the benefit of the invention.

I claim:

1. In a crossbow having a frame, including a stock having a fore end and a rear end portion, flexible bow members, a string and arrow release mechanism and an arrow rest supported on the stock, the improvement comprising cooperative magnetic means on the arrow and said stock to releasably retain an arrow against said arrow rest in a ready firing position on said arrow rest prior to shooting the same to prevent inadvertent displacement of the arrow from the ready firing position, and wherein said cooperative magnetic means comprising a magnet and magnet supporting means on said stock to adjustably position the magnet adjacent to ferromagnetic means on said arrow, and wherein said support means comprises a ferromagnetic tray that is magnetically attracted to said magnet and said tray is sized to adjustably receive said magnet and said magnet supporting tray including mounting means for vertically adjusting said tray and said magnet to a plurality of fixed positions beneath said arrow, said mounting means including a depending flange portion having a slot and a bolt extending through said slot into said fore end of said stock and wherein said tray is larger than said magnet to allow movement of said magnet fore and aft in said tray and laterally beneath said arrow.

2. The improvement of claim 1 wherein said cooperative magnetic means provides clearance between said arrow head and said magnet.

3. The improvement of claim 1 wherein the magnet is shaped to interfit in close proximity in the angle between the blades of the arrow head.

* * * * *